US012108781B2

(12) United States Patent
Archambault et al.

(10) Patent No.: US 12,108,781 B2
(45) Date of Patent: Oct. 8, 2024

(54) SYSTEM AND METHOD FOR COMPACTING CANNABIS IN A CANNABIS CONE

(71) Applicant: Le Groupe Solid Packaging Robotik Inc., Terrebonne (CA)

(72) Inventors: Robert Archambault, Boisbriand (CA); Daniel Martel, Terrebonne (CA); Harold Bouchard, Bois-des-Filion (CA)

(73) Assignee: Le Groupe Solid Packaging Robotik Inc., Terrebonne (CA)

( * ) Notice: Subject to any disclaimer, the term of this patent is extended or adjusted under 35 U.S.C. 154(b) by 146 days.

(21) Appl. No.: 17/585,818

(22) Filed: Jan. 27, 2022

(65) Prior Publication Data

US 2023/0232889 A1 Jul. 27, 2023

(51) Int. Cl.
*A24C 5/06* (2006.01)

(52) U.S. Cl.
CPC ..... *A24C 5/06* (2013.01)

(58) Field of Classification Search
CPC ..... A24C 5/06
See application file for complete search history.

(56) References Cited

U.S. PATENT DOCUMENTS

2019/0320709 A1* 10/2019 Kaufmann ..... A24C 5/06
2020/0068947 A1* 3/2020 Leadbeater ..... A24C 5/06

* cited by examiner

*Primary Examiner* — Christopher M Rodd
*Assistant Examiner* — Daniel Edward Vakili
(74) *Attorney, Agent, or Firm* — Agence de Brevets Fournier

(57) ABSTRACT

A system for compacting cannabis in a cannabis cone comprises i) a cone gripper that is movable between an open position and a closed position around the cannabis cone; wherein, while in the closed position, the cone gripper applies pressure onto the cannabis cone that is sufficient to hold the cannabis cone; ii) a compaction rod, having a tip, for compacting cannabis in the cannabis cone, the compaction rod being reciprocable along an axis between a retracted position, wherein the tip is out of the cannabis cone, and an extended position, wherein the tip is inserted in the cannabis cone; and iii) a protective collar that is movable within the cannabis cone, coaxially thereof, near the open top thereof, so as to define a barrier between the compaction rod and the cannabis cone when the compaction rod reciprocates in the cannabis cone.

15 Claims, 13 Drawing Sheets

SYSTEM AND METHOD FOR COMPACTING CANNABIS IN A CANNABIS CONE

FIELD

The present disclosure generally relates to cannabis joints and more specifically to a system for compacting cannabis in a cannabis cone.

BACKGROUND

Cannabis joints have long been and are still very often prepared by hands.

However, the legalization of cannabis in many territories have seen the coming of the automatization in the manufacturing of cannabis joint.

Some of the automated processes in the manufacturing of cannabis involve inserting paper cones in a cone holding tray and then vibrating the whole tray while it receives cannabis in bulk, the vibrations aiming at evening out the filling of the cones.

A drawback of such vibrating tray is that strong and moderate vibrations have been found to separate the delta-9-tetrahydrocannabinol (THC) from cannabis, thereby decreasing the quality of the product.

Another known automated process for the filling of cannabis includes literally injecting cannabis in each cone and then compacting the cannabis.

Drawbacks of such cannabis injection include separation of THC as described hereinabove and the lack of uniformity along the length of the cone considering its shape.

One of the problems of a machine compacting cannabis in a paper cone while forming a joint is that it is difficult to put enough pressure onto the cannabis to yield an efficient joint while preserving the integrity of the cannabis cone.

SUMMARY

According to an illustrative embodiment, there is provided a system for compacting cannabis in a cannabis cone, the system comprising:

a cone gripper that is movable between an open position and a closed position around the cannabis cone; wherein, while in the closed position, the cone gripper holding the cannabis cone;

a compaction rod, having a tip, for compacting cannabis in the cannabis cone; the compaction rod being reciprocable along an axis between a retracted position, wherein the tip is out of the cannabis cone, and an extended position, wherein the tip is inserted in the cannabis cone;

a protective collar that is movable within the cannabis cone, coaxially thereof, near the open top thereof, so as to define a barrier between the compaction rod and the cannabis cone when the compaction rod reciprocates in the cannabis cone.

According to a more specific illustrative embodiment, there is provided a system for compacting cannabis in a cannabis cone, the system comprising:

a cone holder having a bore for receiving the cannabis cone therein and for holding the cannabis cone in a first position along the axis;

a cone-raising mechanism for moving the cannabis cone up to a second position along the first axis;

a cone gripper that is movable between an open position and a closed position around the cannabis cone while the cannabis cone is at the second position; wherein, while in the closed position, the cone gripper applies holding the cannabis cone;

a compaction rod, having a tip, for compacting cannabis in the cannabis cone while the cannabis rod is held by the cone gripper; the compaction rod being reciprocable along an axis between a retracted position, wherein the tip is out of the cannabis cone, and an extended position, wherein the tip is inserted in the cannabis cone;

a protective collar that is movable, by the compacting rod, within the cannabis cone, coaxially thereof, near the open top thereof, so as to define a barrier between the compaction rod and the cannabis cone when the compaction rod reciprocates in the cannabis cone;

wherein, the cone gripper, while the cannabis cone is at the second position, is operated to apply a gripping force onto the cannabis cone which is lower than a compacting force reached by the compaction rod between the retraced and extended positions thereof, so that the cannabis cone partly moves in a same direction with the compaction rod along the axis, gradually diminishing the compacting force.

According to another illustrative embodiment, there is provided a method for compacting cannabis in a cannabis cone having an opening and a bottom, the method comprising:

while holding the cannabis cone:

i) inserting in the opening of the cone an inner protective collar; and ii) inserting a pusher rod having a tip in the cone through the inner protective collar and moving the pusher rod towards the bottom of the cone until the tip reaches a certain distance from the opening so that the pusher rod exerts a force that pushes onto the cannabis therein.

Other objects, advantages, and features of the system and for method for compacting cannabis in a cannabis cone will become more apparent upon reading the following non-restrictive description of illustrative embodiments thereof, given by way of example only with reference to the accompanying drawings.

DETAILED DESCRIPTION

Figure 1:
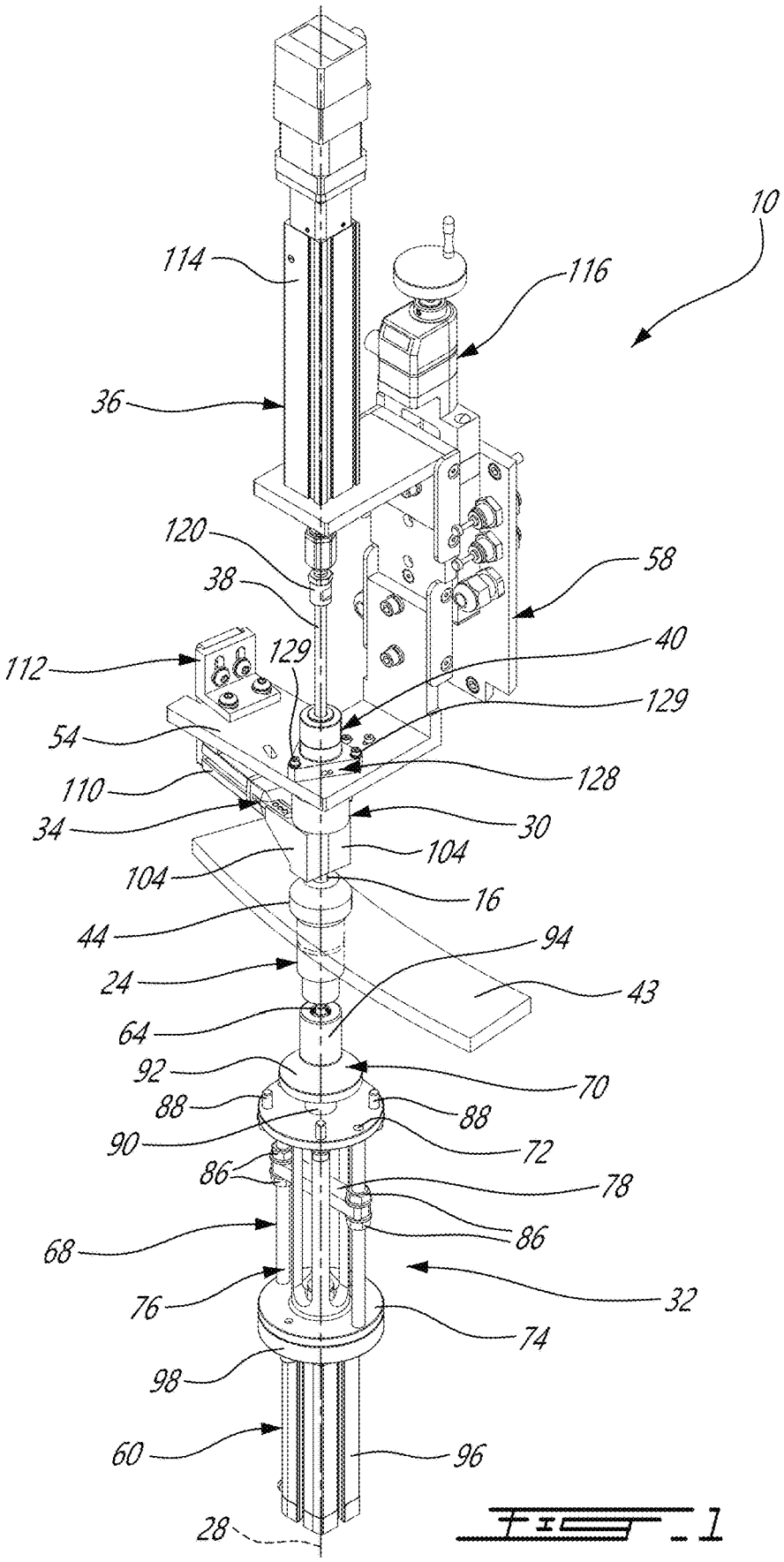
FIG. 1 is a perspective view of a system for compacting cannabis in a cannabis cone according to a first illustrative embodiment.

In the following description, similar features in the drawings have been given similar reference numerals, and in order not to weigh down the figures, some elements are not referred to in some figures if they were already identified in a precedent figure. Herein, it shall further be noted that, for avoiding unnecessary details obscuring the invention, only device structures and/or processing steps closely relevant to schemes according to the invention are shown in the accompanying drawings while omitting other details less relevant to the invention.

The use of the word "a" or "an" when used in conjunction with the term "comprising" in the claims and/or the specification may mean "one", but it is also consistent with the meaning of "one or more", "at least one", and "one or more than one". Similarly, the word "another" may mean at least a second or more.

As used in this specification and claim(s), the words "comprising" (and any form of comprising, such as "comprise" and "comprises"), "having" (and any form of having, such as "have" and "has"), "including" (and any form of including, such as "include" and "includes") or "containing" (and any form of containing, such as "contain" and "contains"), are inclusive or open-ended and do not exclude additional, un-recited elements.

A first illustrative embodiment of a system 10 for compacting cannabis 14 in a cone 12 (only partly visible in FIG. 1) will now be described with reference first to FIGS. 1, 2, 3 and 3A.

As will become more apparent upon reading the following description, the system 10 allows compacting a portion of cannabis 14 already filled in a paper cone 12. The product defined by the paper cone 12 being pre-filled with cannabis 14 and that is fed to the system 10 will be referred to as a cannabis cone 16.

The portion of cannabis 14 will also be referred to as a single dose of cannabis 14 and is a predetermined quantity of cannabis provided to form a joint (not shown) with the paper cone 12. Of course, such a single dose 14 may vary depending, for example, on the size of the paper cone 12 to fill.

The paper cone 12 is made, for example, of paper derived from hemp or palm leaves, but can alternatively be made of another material.

Figure 3:
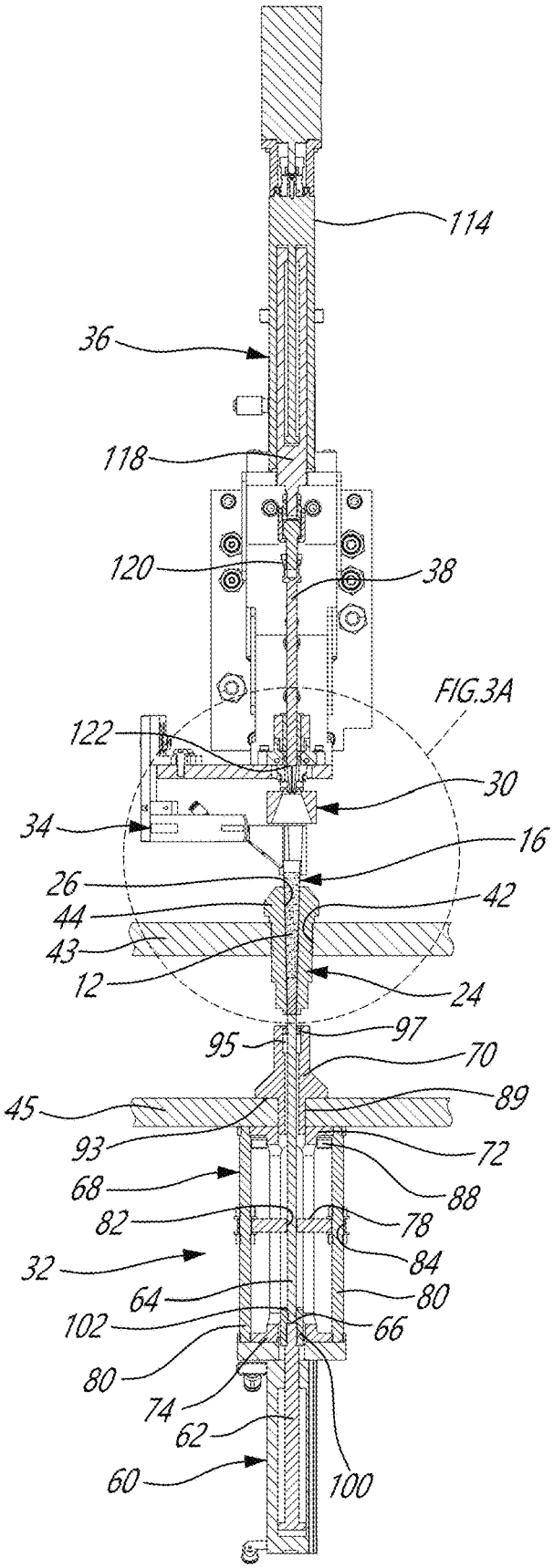
FIGS. 3 and 3A are respectively cross sectional and close-up views of the system from FIG. 1, showing the cannabis cone being raised by the cone pusher.
Figure 3A:
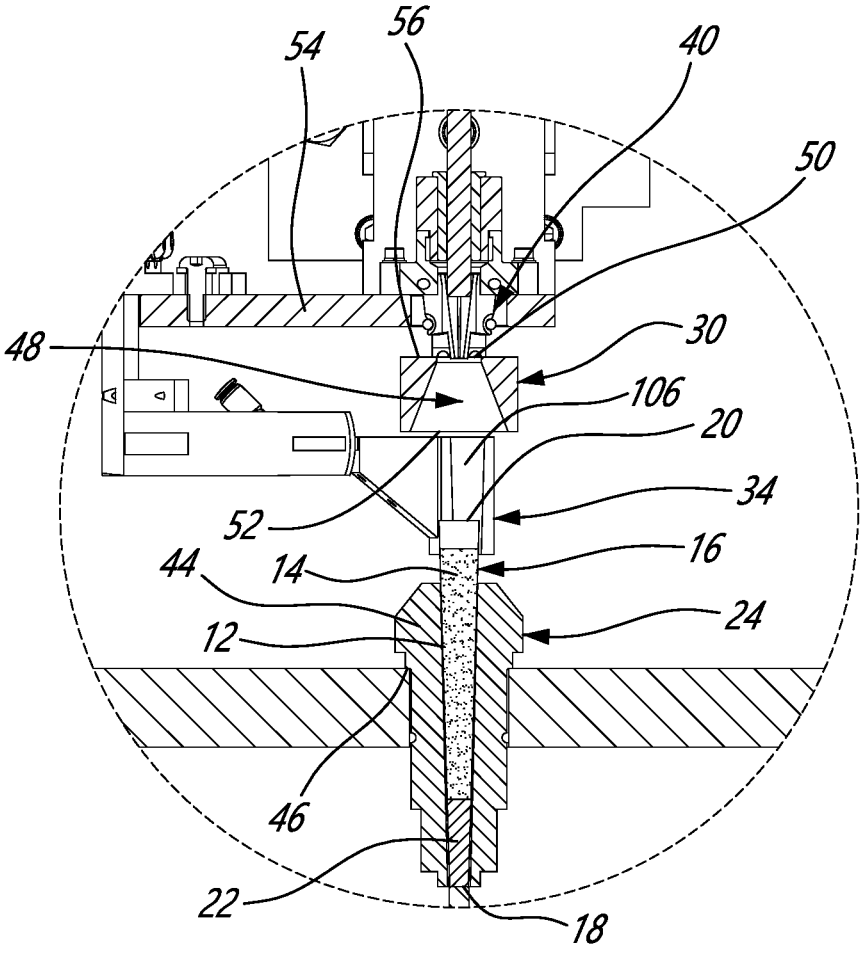

With reference briefly more specifically to FIG. 3A, the cone-shaped intermediary product 16 has a truncated thinner tip 18 and a wider base 20. A filter 22 is provided at its tip 18, which prevents marijuana from falling therethrough during transport and handling and that stops resin from clogging the end of the resulting joint.

Referring to the orientation of the cannabis cone 16 during its compacting by the system 10 and to the compacting method 200, both further described hereinbelow, the tip 18 of the cone 12 will be referred to herein as its bottom, and the base 20 will be referred to as its opened top.

The cannabis cone 16 is an intermediary product in the manufacturing of a cannabis joint (not shown). After the cannabis 14 is compacted in the cone 12 by the system 10, the opened top 20 of the cannabis cone 16 will be closed to form the cannabis joint (not shown).

Prior to be compacted in the cone 12 by the system 10, the cannabis 14 might have been pre-compacted or not.

It is to be noted that the manufacturing steps of the cannabis cone 16 prior and after its compacting is beyond the scope of the illustrative embodiment described herein and will not be described herein in more detail.

Also, since cannabis cones 16 are believed to be well-known in the art, they will not be described herein in more detail for concision purposes.

The compacting system 10 comprises i) a cone holder 24 having a bore 26 for receiving the cannabis cone 16 therein and for holding the cannabis cone 16 in a first position along an axis 28 coaxial with the bore 26, ii) an inverted funnel 30 positioned coaxially to the axis 28 at a distance from the cone holder 24, iii) a cone-raising mechanism 32 for moving the cannabis cone 16 through the inverted funnel 30 up to a second position along the axis 28, iv) a cone gripper 34 that is movable between an open position (see FIG. 2) and a closed position (see FIG. 2A) around the cannabis cone 16 at the second position, v) a cannabis compaction mechanism 36, including a rod 38 that is reciprocable along the axis 28, for compacting the cannabis 14 in the cannabis cone 16, and an expandable protective collar 40 that is movable by the compaction rod 38 to form a barrier between the compaction rod 38 and the cannabis cone 16 when the compaction rod 38 reciprocates in the cannabis cone 16.

Each of these parts 24-26, and 30-40 of the system 10 will now be described in more detail.

The cone holder 24 is in the form of an elongated body having a frusto-conical bore 26 therein that is configured and sized to receive a cannabis cone 16 therein in a snugly fit manner so as to prevent the deformation and breakage of a cone 12 therein during the compaction of the cannabis 14 therein.

According to the illustrative embodiment, the cannabis cone holder 24 is one of a series of such holders 24 that are freely mounted in corresponding holes 42 in a carrousel 43. The carrousel 43 is provided to facilitate the consecutive compacting of a plurality of cannabis cones 16. The carrousel 43 is rotatably secured to a table 45 via an electric motor (not shown) or another rotation actuator. Since a carrousel is believed to be well-known in the art, it will not be described herein in more detail for convenience purposes.

According to another embodiment (not shown), the cannabis cone holder 24 is mounted to another support or mechanism than the carrousel 43 that allow receiving and supporting a single cone holder or sequentially a plurality thereof.

The cone holder 24 includes a wider head portion 44, defining a shoulder portion 46 that provides support to the holder 24 when deposited into the hole 42.

The cone holder 24 is not limited to the illustrative embodiment and can take other form allowing to receive and support a cannabis cone 16 in a snugly fit manner.

The inverted funnel 30 includes a frusto-conical bore 48 defining top opening and bottom openings 50 and 52 of the funnel 30. The top opening 50 has a diameter slightly greater than the base 20 of the cannabis cone 16 so as to allow its snugly fit passage therethrough. The bottom opening 52 is wider than the top opening 50, resulting in a shape of the bore 48 that facilitates the rapid passage of the cannabis cone 16 through the funnel 30 from the bottom thereof.

While the funnel 30 is illustrated having an outside shape that is circular, it is not limited to such a shape.

The funnel 30 is secured to a plate portion 54 thereunder via a mounting bracket (not shown) secured on the side of the funnel 30. According to another embodiment (not shown), the funnel 30 is secured to the plate portion 54 from its top side 56.

The plate portion 54 has a generally L-shaped and extends generally parallel to the carrousel 43. The L-shaped plate portion 54 is part of a mounting assembly 58 that allows assembling and relatively positioning the funnel 30, the cone gripper 34 and the compaction mechanism 36. The mounting assembly 58 will be further described hereinbelow.

The cone raising mechanism 32 includes i) a linear actuator 60, having an output shaft 62, ii) a rod 64 secured to the output shaft 62 at the free end 66 thereof so as to define an extension thereof, iii) a rod course length adjusting assembly 68 for limiting the course of the shaft 62, and therefor of the rod 64, and iv) a rod-guiding sleeve 70 coupled to the course-length adjusting assembly 68.

The rod course length adjusting assembly 68 includes top and bottom parallel mounting caps 72 and 74 that are assembled and distanced by a spacer frame 76, and a mechanical stop 78 that is adjustably mounted to both mounting caps 72-74 therebetween. More specifically, the mechanical stop 78 is mounted to the caps 72-74 via two threaded rods 80 that are fixedly mounted to both caps 72-74 therebetween on diametrically opposite locations.

The mechanical stop 78 is in the form of a narrow plate that includes a first central hole 82 to allow passage for the rod 64 for free reciprocal movement therethrough, and two mounting holes 84, each receiving a respective threaded rod 80 therein. A person skilled in the art will now appreciate that the above-described arrangement allows the slidable movement of the mechanical stop 78 between both caps 72-74 parallel thereto. A pair of nuts 86 is provided to secure the mechanical stop 78 on each threaded rod 80 at a selected position thereon. The spacer frame 76 is configured to allow the afore mentioned slidable movement of the mechanical stop 78.

The rod course length adjusting assembly 68 is secured to the table 45 thereunder via its top cap 72 using fasteners 88. A hole 89 in the table allows passage for the rod 64 therethrough.

The rod-guiding sleeve 70 is in the form of a one-piece body having a bottom cylindrical portion 90 that is sized for snugly fit insertion in the table hole 89, an enlarged portion 92 that extends from the bottom cylindrical portion 90 and that defines a shoulder portion 93 therewith, and a top cylindrical portion 94 that extends from the enlarged portion 92 at a longitudinal side thereof opposite the bottom cylindrical portion 90. The top cylindrical portion 94 includes a housing at the distal end thereof, that receive a cylindrical guide, in the form of a bushing 95, and a seal 97 to prevent cannabis 14 from entering the sleeve 70. The top cap 72 includes a hole (not shown) to receive the bottom cylindrical portion 90 of the sleeve 70 therein in a snugly fit manner. The rod guiding sleeve 70 includes a longitudinal bore to allow passage for the rod 64 though therethrough.

The main body 96 of the linear actuator 60 is secured to the bottom cap 74 thereunder via a mounting plate 98 using fasteners or other fastening means or a mounting assembly. The bottom cap 74 and mounting plate 98 are provided with respective registered holes to allow passage for the output shaft 62 of the linear actuator 60 therethrough.

The rod 64 is secured to the output shaft 62 by a cylindrical coupler 100, which further acts as an impactor. For that reason, a rubber ring 102 is provided about the rod 63 onto the coupler 100.

In operation of the cone raising mechanism 32, the linear actuator 60 is actuated so that both its output shaft 62 and the rod 64 are moved upwardly towards the cone holder 24 in unison. This translation of both the shaft 62 and the rod 64 is stopped when the impactor 100 abuts the mechanical stop 78.

The mechanical stop 78 is so positioned that the movement of the rod 64 stops when the cannabis cone 16 is slided out a predetermined height from the cone holder 24, extending partially out of the inverted funnel 30 from a side thereof opposite the cone raising mechanism 32. Of course, the cone raising mechanism 32 is positioned relative to the cone holder 24 and inverted funnel 30 so that the rod 64 is substantially coaxial with both the cone holder 24 and inverted funnel 30.

While the linear actuator 60 according to the first illustrative embodiment is of the pneumatic type, it can also be of another type, including without limitations hydraulic or electric.

Also, another mechanism or assembly than the rod course length adjusting assembly 68 can be provided to adjust or limit the course of the rod 64.

According to still another illustrative embodiment, the cone raising mechanism 32 is omitted.

The position of the cannabis cone 16 while in the cone holder 24 will be referred to as its first position along the axis 28 and its position after being raised by the cone-raising mechanism 32 will be referred to as its second position along the axis 28.

Figure 2:
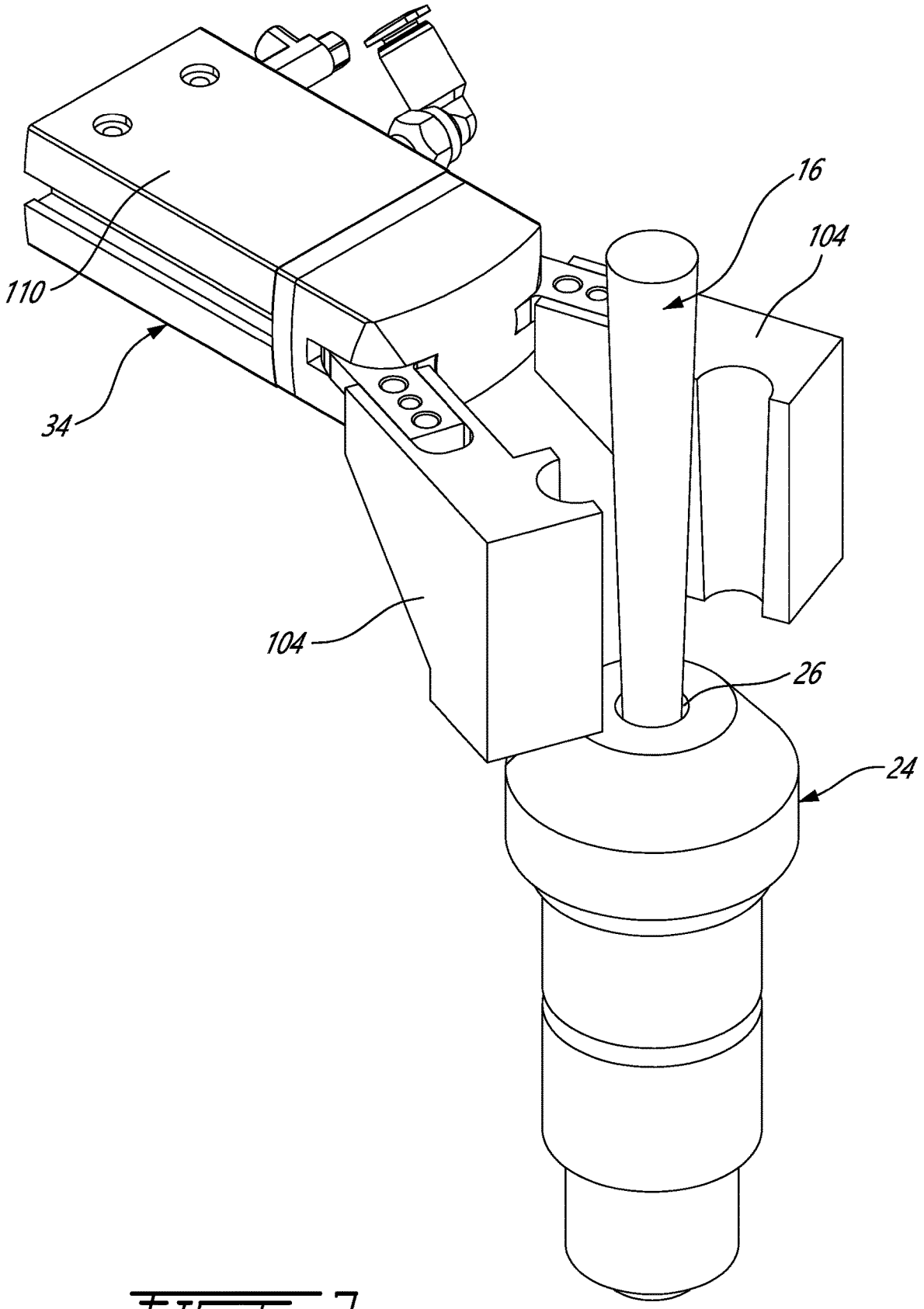
FIGS. 2 and 2A are perspective views of the cone gripper that is part of the system from FIG. 1, respectively showing the cone gripper opened and closed onto a cannabis cone
Figure 2A:
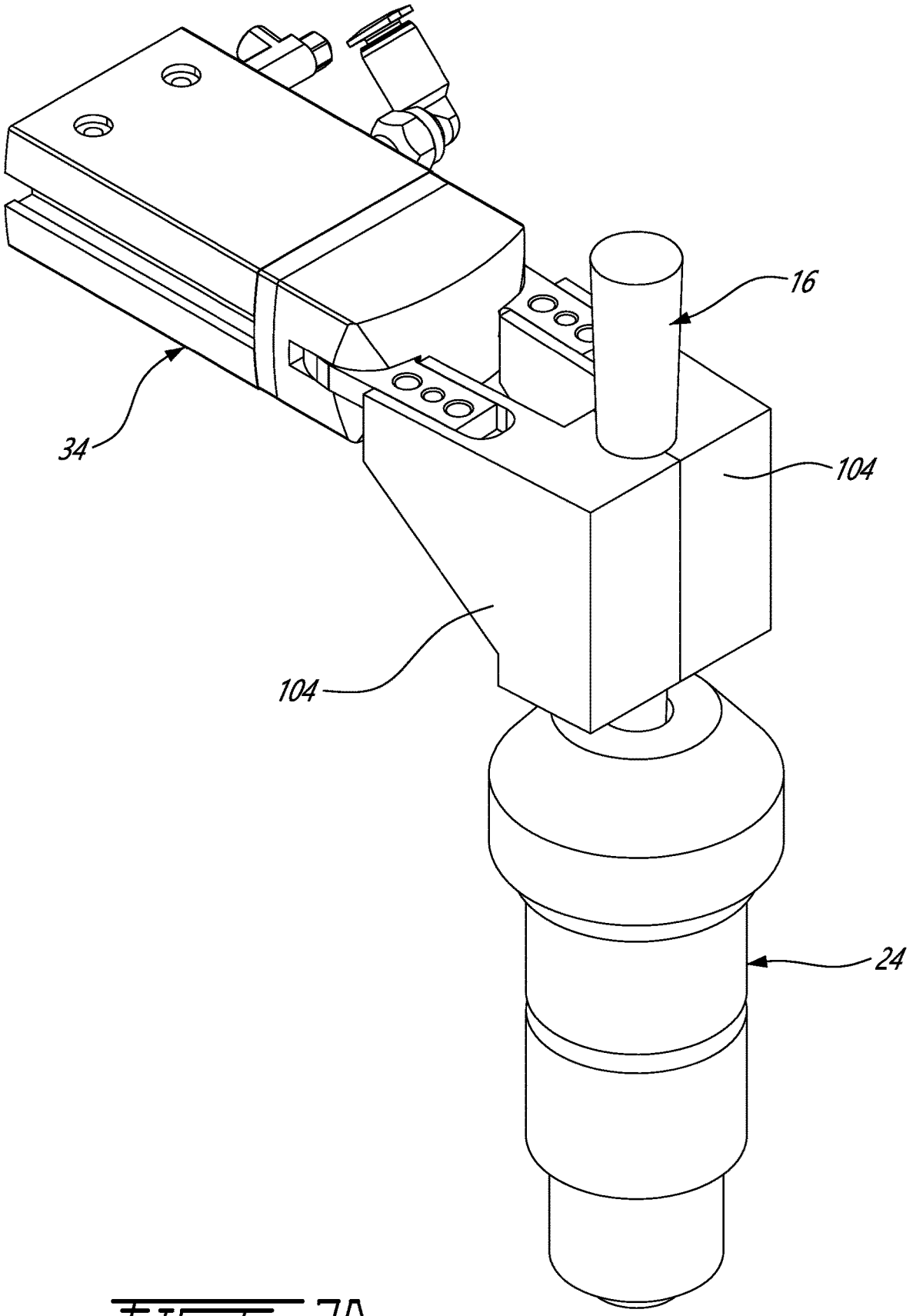

The cone gripper 34 will now be described with references to FIGS. 1, 2, and 2A.

The cone gripper 34 is in the form of a well-known pneumatic gripper that is equipped with fingers 104 that are configured with arcuate tapered channels 106 that cooperates to form a frusto-conical opening 108 when the gripper 34 is closed. The opening 108 is configured and sized to substantially complement a cannabis cone 16.

The cone gripper 34 is secured, via its main body 110 to the plate portion 54 of the mounting assembly 58 using a mounting bracket 112. The mounting bracket 112 is configured so that the opening 108 of the cone gripper 34 is coaxial with the axis 28 when in its closed position (see Figure FIG. 2A). It results that the cone gripper 34 is closed onto a cannabis cone 16 when it is at the second position along the axis 28.

It results from the frusto-conical shape of the opening 108, which is complementary to the cannabis cone 16, that a minimal pressure is required for the cone gripper 34 to hold the cannabis cone 16. Also, the shape of the opening 108 formed by the gripper 34, when its fingers 104 are closed, being complementary to the cannabis cone 16, contributes to stabilize the cannabis cone 16 when it is compacted by the compaction mechanism 36 and minimized strain thereon and hence its damaging.

While the gripper 34 has been described as being of the pneumatic type, it can also be of another type, including without limitations hydraulic or electric.

Also, the fingers 104 are limited to the above-described configuration.

The compaction mechanism 36 will now be described in more detail with references to FIG. 1.

The compaction mechanism 36 comprises a linear actuator 114 that is secured to the mounting assembly 58 via a position-adjustment mechanism 116 which allows adjusting the position of its output shaft 118 along the axis 28.

According to another illustrative embodiment, such a position-adjustment mechanism 116 is omitted and the linear actuator 114 is fixedly positioned relatively to the neutral position of the cone holder 24 via the mounting assembly 58 or else.

The compaction rod 38 is secured to the output shaft 118, coaxially thereto, using a conventional cylindrical coupler 120. The length of the rod 38, the position of the compaction mechanism 36 relative to the second position of the cannabis cone 16 along the compacting axis 28, and the configuration of the linear actuator 114 are such that the rod 38 can reciprocate along the axis 28 between a retracted position, wherein the tip 122 of the rod 38 is out of the cannabis cone 16 while at the second position (see for example in FIGS. 3 and 3A), and an extended position, wherein the tip 122 is inserted a predetermined distance in the cannabis cone 16 from the open top thereof 20 (see FIGS. 8 and 8A). As will be described hereinbelow in more detail, this predetermined distance in the cannabis cone 16 may vary, considering that the position of the cannabis cone 16 may also vary during the compacting.

According to the first illustrative embodiment, the linear actuator 114 if of the pneumatic type, but it can alternatively be of another type, including without limitations hydraulic or electric. For example, the use of an electric actuator allows a more precise control of the insertion distance of the rod 38 in the cannabis cone 16 during compaction.

To prevent the compaction rod 38 from touching the paper cone 12 during its reciprocating movement therein, an expandable protective collar 40 is provided that is movable when the compaction rod 38 moves from the retracted position to the extended position. The expandable protective collar 40 is thus movable between a compact position in the cannabis cone 16 (see FIG. 4A for example) and a generally annular position within the cannabis cone 16, coaxially thereof, near the open top thereof (see FIG. 8A for example). In this last position, the expandable protective collar 40 defines a barrier between the compaction rod 38 and the paper cone 12 when the compaction rod 38 reciprocates in the cannabis cone 16.

With reference to FIGS. 1, 4-4A and 9A-9B, the expandable protective collar 40 will be described in more detail.

The expandable protective collar 40 comprises a clamp 124 including three (3) jaws 126 pivotably mounted to a mounting body 128 for pivotal movement between close and open position (see FIGS. 9A and 9B respectively), a biasing member in the form of a rubber ring 130 for biasing the jaws 126 towards their close position, and a rod support member 132 secured to the mounting body 128 on a side thereof opposite the jaws 126.

According to the first illustrative embodiment, the mounting body 128 includes a small triangular attaching portion 133 that is secured to the plate portion 54 of the mounting assembly 58 using fasteners 129 and a cylindrical connecting portion 134 extending upwardly from the attaching portion 132. The mounting body 128 further includes a circular hole 135 that is coaxial with the compacting axis 28.

The rod support member 132 includes a holding ring 136 that includes a narrow connecting portion 138 for coupling with the cylindrical connecting portion 134 therein. Both the narrow holding ring 138 and cylindrical connecting portion 134 are configured for complementary attachment, for example by clipping or screwing. A guiding sleeve 140 in the form of a bushing is inserted in the cylindrical member 136. The sleeve 140 is configured for snugly-fit insertion in the cylindrical member 136 and to allow passage for the rod 38 therethrough in a snuggly fit manner.

Each jaw 126 of the clamps 124 includes a mounting portion 142 and a thin arcuate finger portion 144 extending therefrom.

The mounting portion 142 is in the form of a generally rectangular body having top and bottom sides 146 and 148, two lateral sides 150, and outer and inner sides 152 and 154.

Each jaw 126 of the clamps 124 includes a mounting portion 142 and a thin arcuate finger 144 extending therefrom.

Figure 9A:
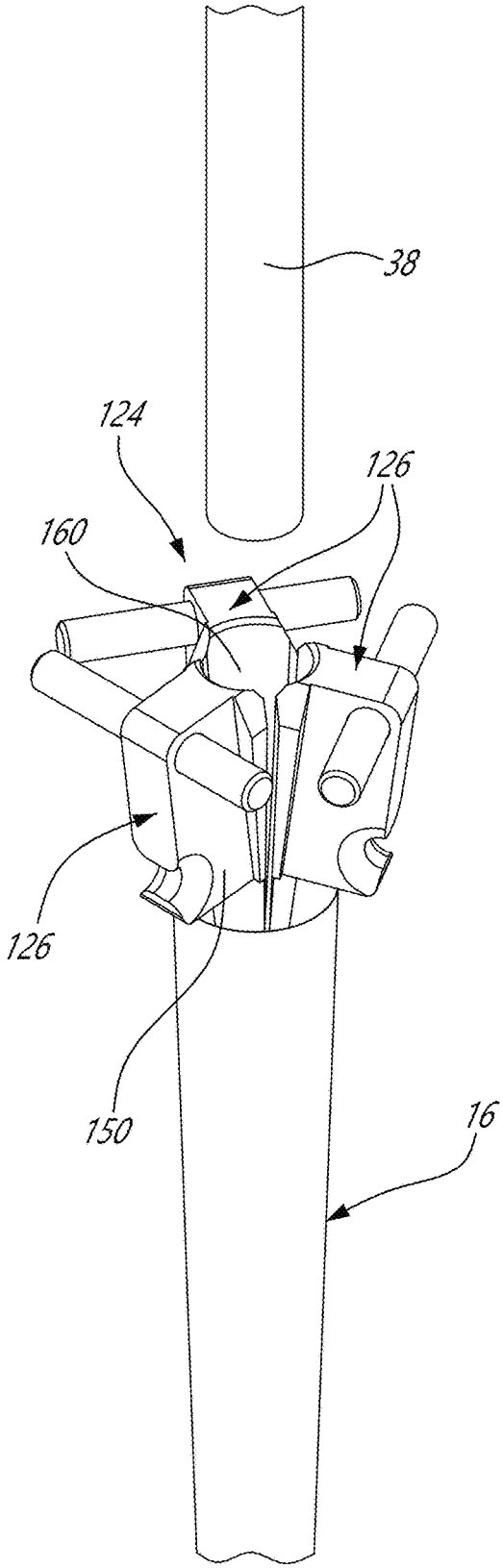
FIGS. 9A and 9B are isolated perspective views of the pusher rod and part of the protective collar, illustrating the protective collar expanding under the passage of the pusher rod therethrough.
Figure 9B:
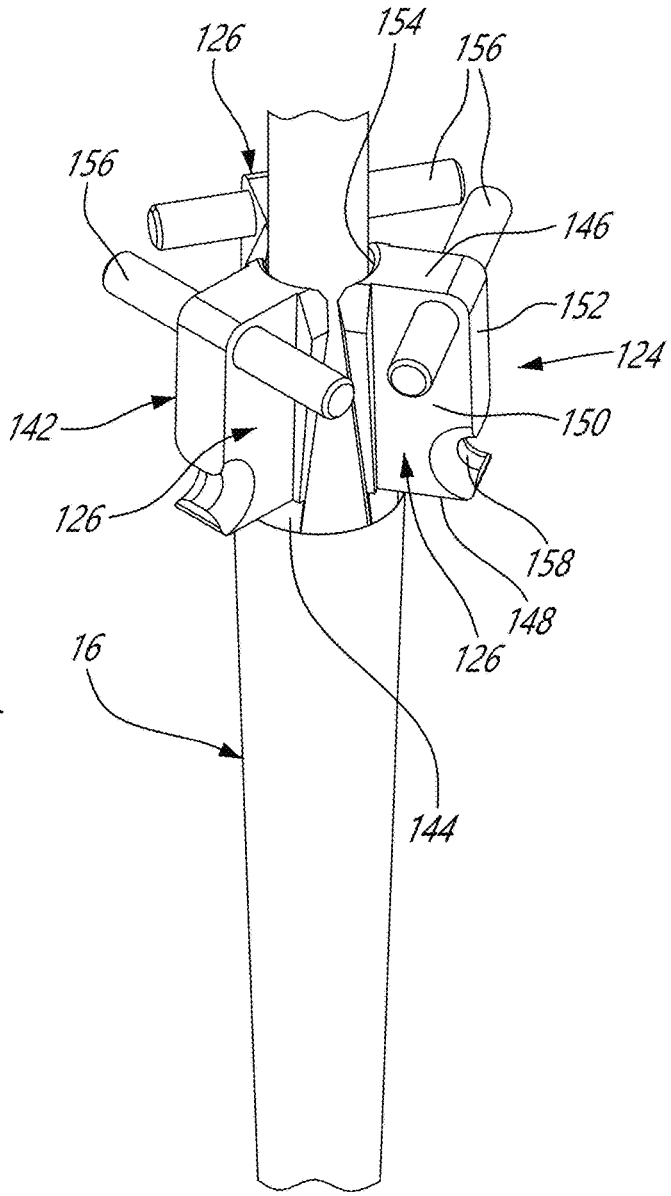

Each mounting portion 142 is pivotably mounted to the triangular attaching portion 128, between two adjacent sides thereof via a pivot pin 156, so as to be freely movable between first and second positions, corresponding respectively to a closed configuration of the clamp 124 (see FIG. 9A) and an open configuration of the clamp 124 (see FIG. 9B). Each pivot pin 156 is inserted transversally through the mounting portion 142 near the intersection of the top and outer sides 146 and 152.

Each mounting portion 142 further includes an arcuate notch 158. These notches 158 define housings that receive the rubber ring 130. The ring 130, which can alternatively be made of another resilient material, such as an elastomer, is configured and sized to bias the three jaws 126 towards their first position. According to another illustrative embodiment (not shown), the biasing member can be in the form of springs between each jaw 126 and the mounting portion 142.

Each thin arcuate finger 144 is secured to the mounting portion 142 on the inner side 154 thereof so as to extend along the inner side 154 and further beyond the bottom side 148. This configuration of the fingers 144 yields a cylindrical opening 160 that allows complementary receiving the rod 38 when the clamp 124 is in the open configuration. Each jaw 126 further includes tapered lateral wings 162 on both lateral sides 150 of the body 142 adjacent the finger 144.

According to another illustrative embodiment (not shown), the fingers 144 or more generally the jaws 126 are configured differently than illustrated. Also, the pivotal mounting of the jaws 126 may be different than illustrated and so is the biasing member to force the jaws 126 in a compact configuration.

Further details on the expandable protective collar 40 and operation thereof will now be described in more detail while describing the operation of the system 10 for compacting cannabis cone 16 with references to FIGS. 3 to 8A and to a method 200 for compacting cannabis cone 16 as illustrated also in FIG. 10.

FIGS. 3 and 3A illustrate the initial configuration of the system 10, wherein i) a cannabis cone 16 is fully inserted in the cone holder 24, which corresponds to the first position of the cannabis cone 16, ii) the cone gripper 34 is in its open position, and iii) the compaction rod 38 is in its retracted position. Also, since the compaction rod 38 is retracted, the arcuate fingers 144 of the expandable protective collar are forced into a narrow configuration by the biasing force of the rubber ring 130.

Figure 4:
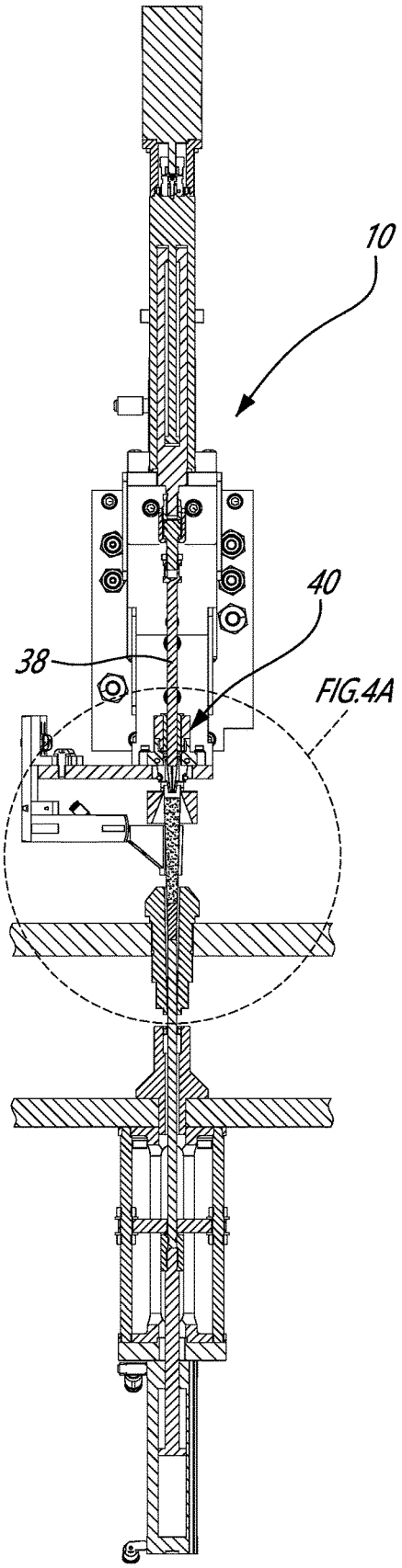
FIGS. 4 and 4A are respectively cross sectional and close-up views of the system from FIG. 1, showing the cannabis cone in position to be gripped by the cone gripper.
Figure 4A:
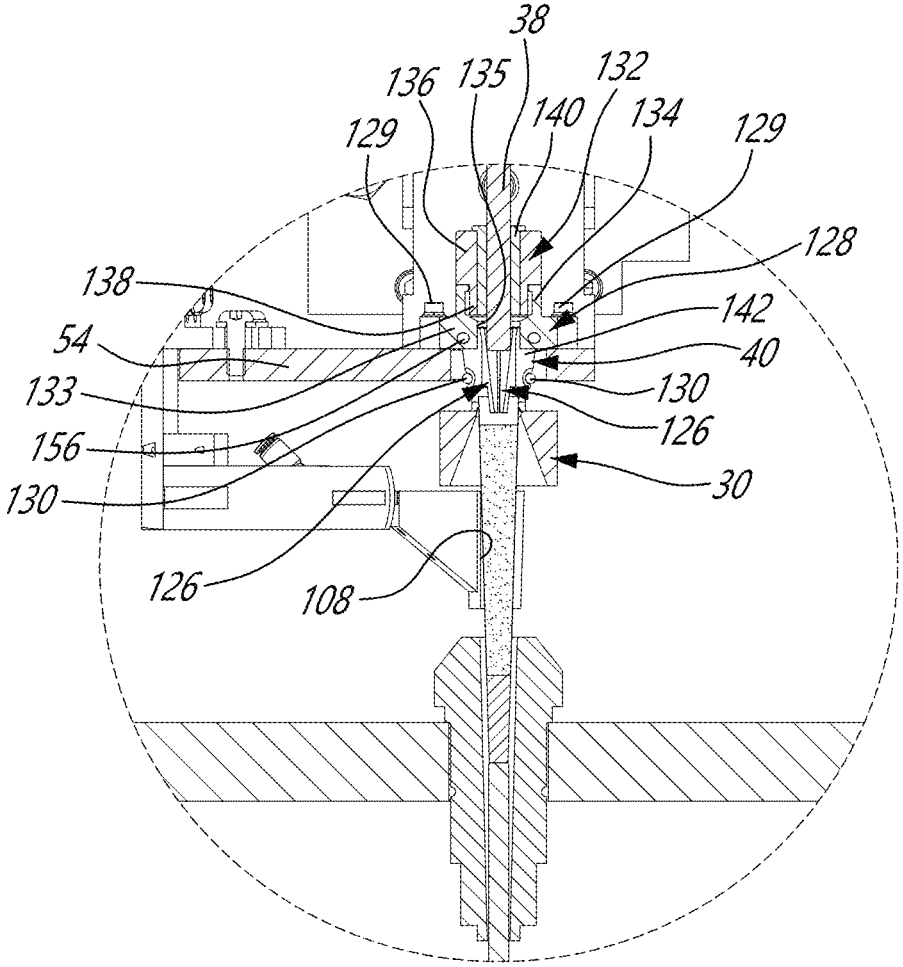

While the expandable protective collar 40 in this configuration, the cannabis cone 16 is raised by the cone-raising mechanism 32, and moved through the inverted funnel 30, until the wide opening 20 of the cannabis cone 16 surrounds the lower portion of the fingers 144 (see FIGS. 4 and 4A). This is summarized in step 202 of the method 200.

Figure 5:
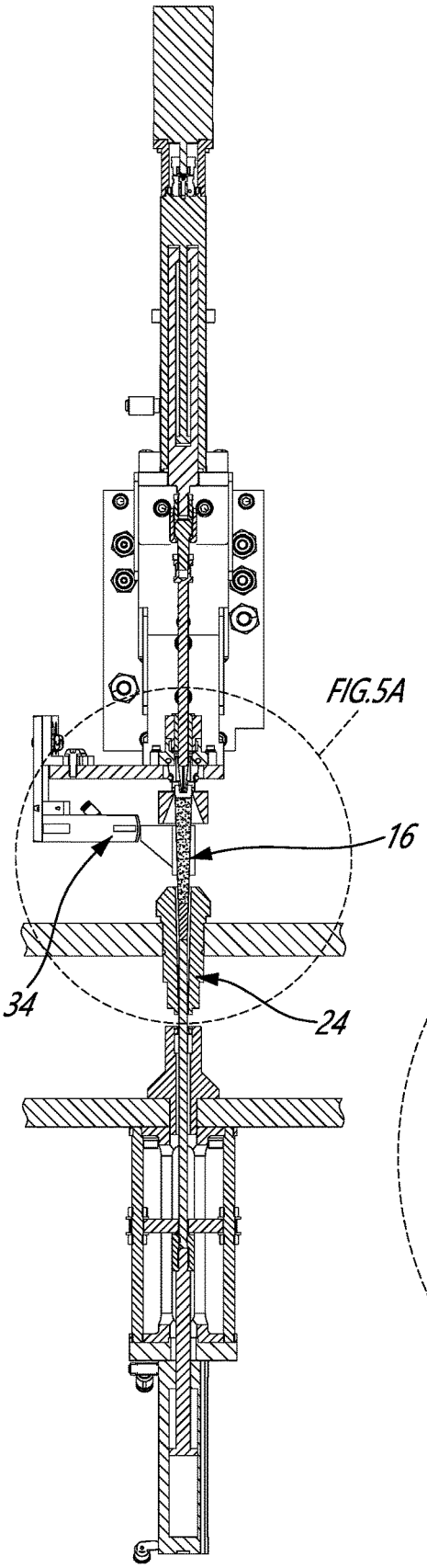
FIGS. 5 and 5A are respectively cross sectional and close-up views of the system from FIG. 1, showing the cone gripper holding the cannabis cone.
Figure 5A:
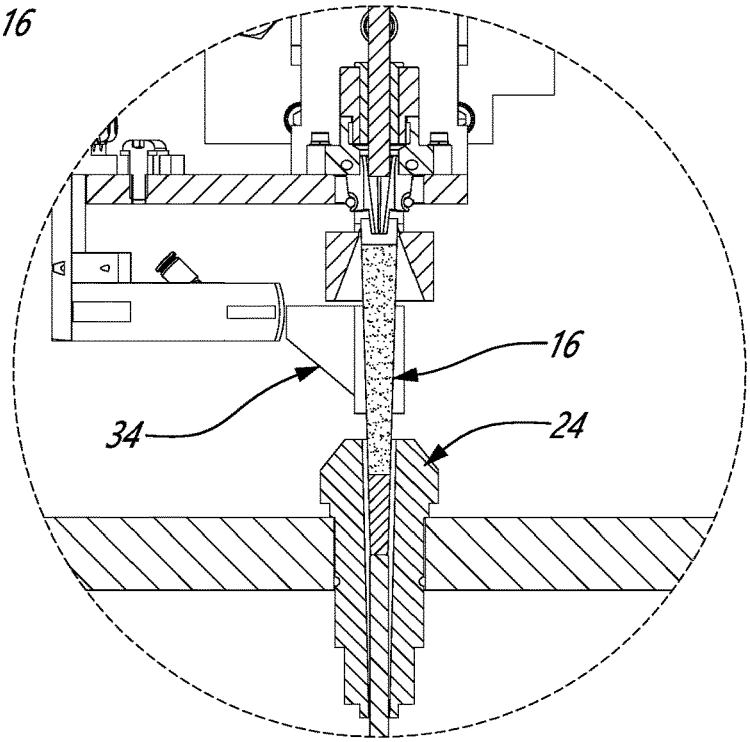

Then the gripper 34 is moved into its closed position, holding the cannabis cone 16 at its second position (see FIGS. 5 and 5A and step 204 of the method 200).

Figure 6:
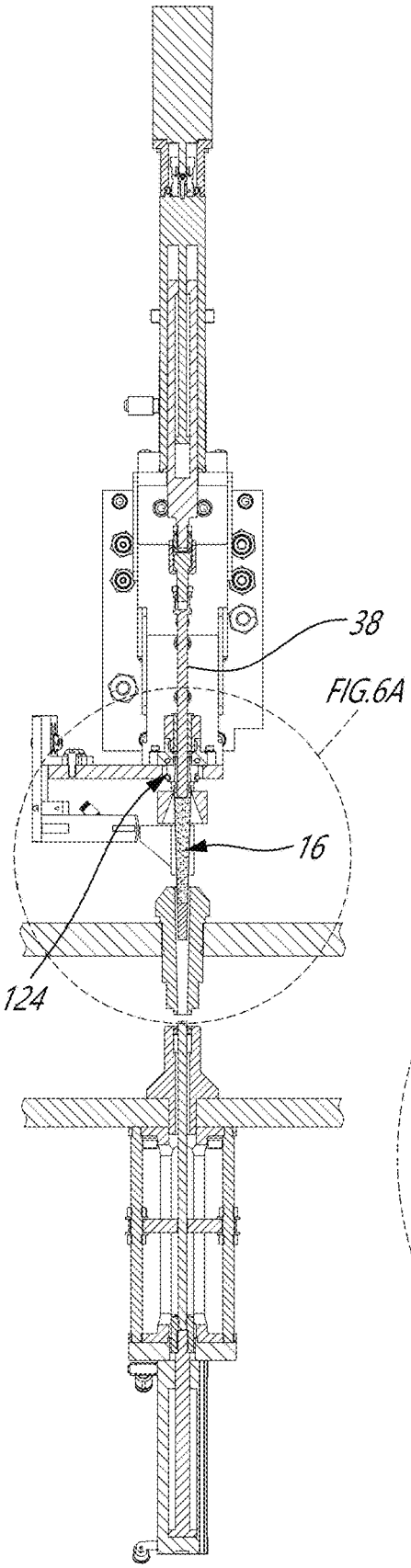
FIGS. 6 and 6A are respectively cross sectional and close-up views of the system from FIG. 1, showing the simultaneous insertion of the pusher rod, inner protective collar and automatic expansion thereof.
Figure 6A:
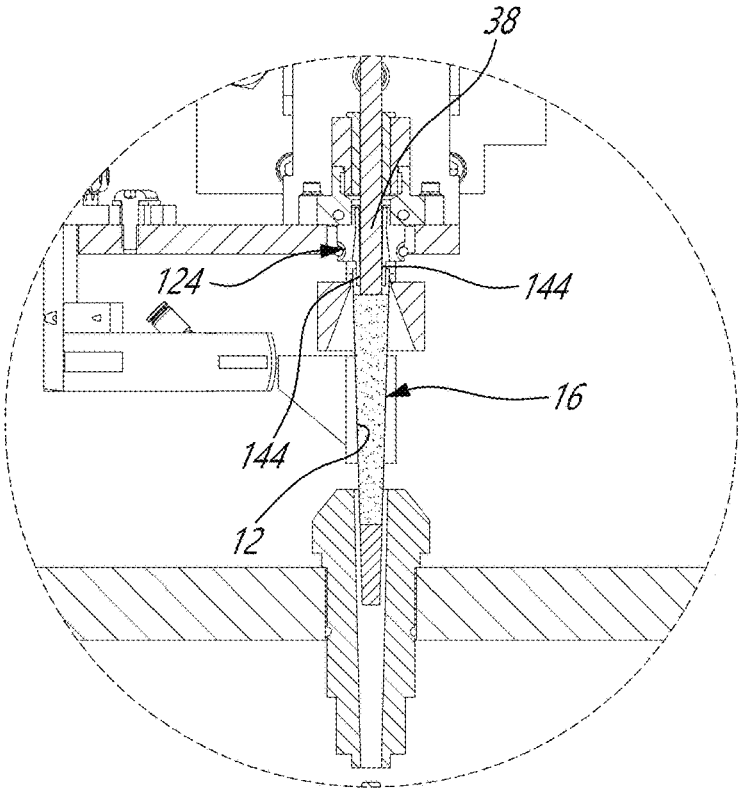

While the cannabis cone 16 is held by the gripper 34, the arcuate fingers 144 are forced towards their second positions by the insertion of the rod 38 therethrough causing the clamp 124 to open under the passage of the rod 38, yielding a protective collar between the rod 38 and the top opening 20 of the paper cone 12 (FIGS. 6 and 6A and step 206 of the method 200). It is to be noted that, while in this position, the protective collar 40 is not in contact with the cannabis cone 16.

Figure 7:
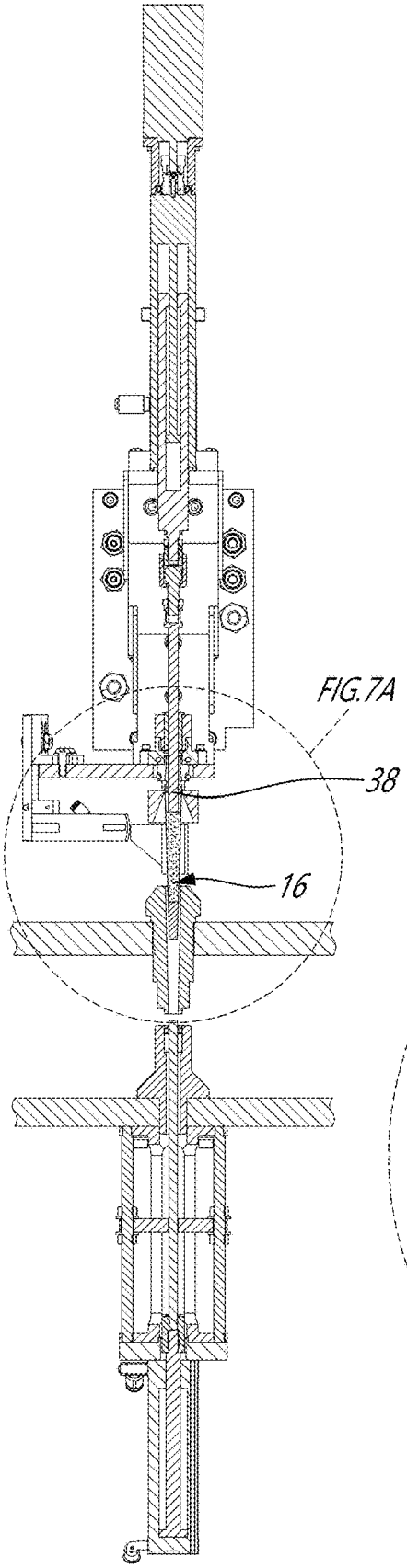
FIGS. 7 and 7A are respectively cross sectional and close-up views of the system from FIG. 1, showing the insertion of the pusher rod in the cannabis cone through the inner protective collar.
Figure 7A:
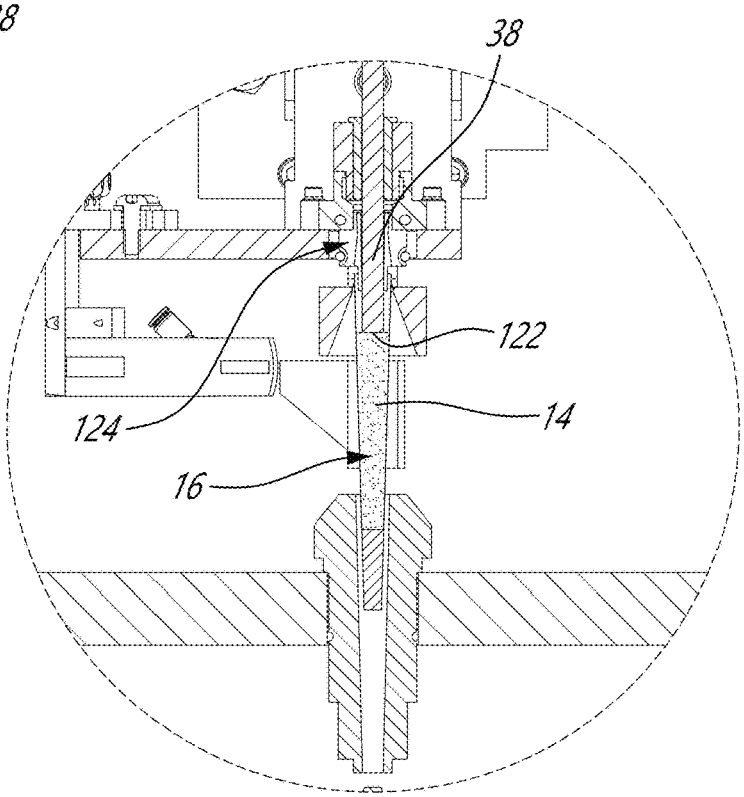
Figure 10:
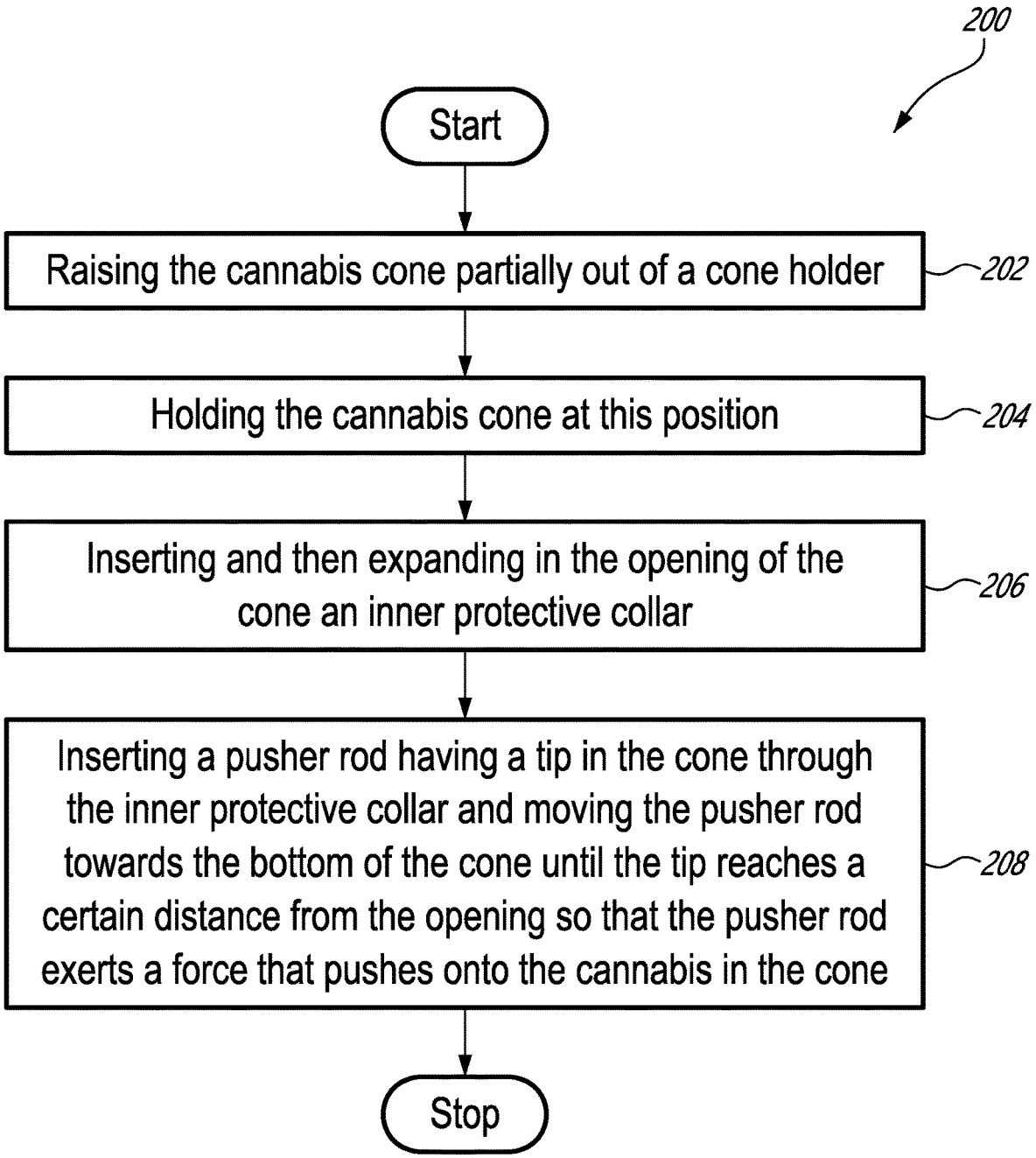
FIG. 10 is a flowchart of a method for compacting cannabis in a cannabis cone.

With reference to FIGS. 6 and 6A, the pusher rod 38 is inserted in the cannabis cone 16 through the inner protective collar defined by the opened clamp 124 and moved towards the bottom of the cannabis cone 16 until the tip 122 of the rod 38 reaches a predetermined distance along the axis 28 so that the pusher rod 38 exerts a force that pushes onto the cannabis 14 in the cannabis cone 16 (see FIGS. 7 and 7A and step 208 in FIG. 10).

Figure 8:
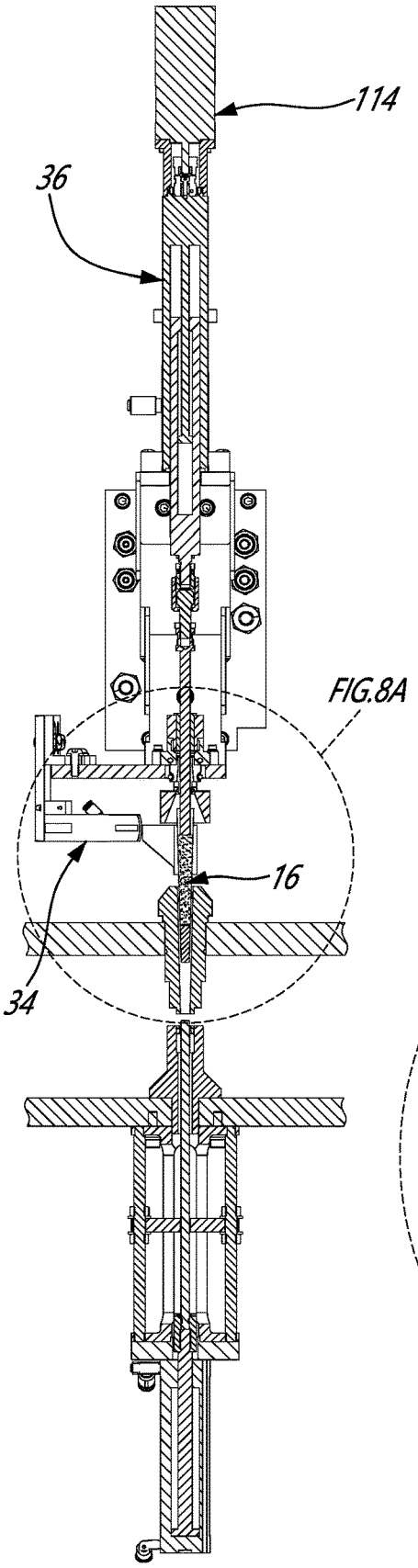
FIGS. 8 and 8A are respectively cross sectional and close-up views of the system from FIG. 1, showing the slight descent of the cannabis cone in the gripper under the compacting force.
Figure 8A:
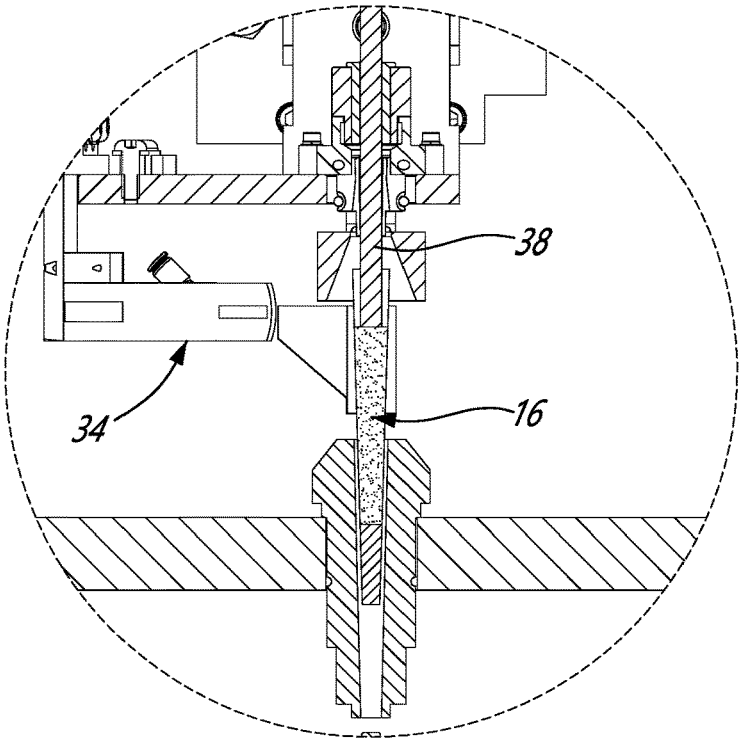

At one point during the downward movement of the compaction rod 38, the cannabis 14 in the cannabis cone 16 reaches such a level of compaction that the downward force of the rod 38 is greater than the gipping force applied by the gripper 34 onto the cannabis cone 16, forcing the cannabis cone 16 to move downwardly with rod 38 (see FIGS. 8 and 8A). Such a constant force applied by the gripper 34 onto the cannabis cone 16 is adjustable to reach a desired level of compaction of the cannabis 14 in the cone 12.

The system 10 can further be operated so that the following, for example, can be adapted to yield a final product having different characteristics:

- there can be more than one reciprocation of the rod 38 within the cannabis cone 16 (steps 206 and 208);
- the second position of the cannabis cone 16 and the travel distance of the rod 38 within the product may be adapted to yield a product having specific characteristics; and
- the precise control of the movement of the rod 38, for example, using an electric actuator 114, allows a more precise end position of the tip 122 of the rod 38 in the cone 16, yielding a more precise compaction force into the cannabis cone 16.

It is to be noted that all the actuators described hereinabove are connected to one or more controllers (not shown) so that their operations are triggered and synchronized thereby. All the connectors between such controller(s) and the actuators have been omitted in the drawings so as to alleviate the views.

It is to be noted that many modifications could be made to the cannabis joints compacting system 10 and method 200 described hereinabove and illustrated in the appended drawings. For example:

- the diameter, length and/or shape of the pusher rod 38 may be different than illustrated; and
- while the protective collar 40 has been described herein as being expandable by the passage of the pusher rod 38 therethrough, it can be made actionable via another mechanism or being in a fixed expanded configuration;
- the configuration, size and number of the mounting elements may be different than illustrated;
- the removable assembly of components of the system 10, using for example fasteners, brackets, or mounting assemblies, may be replaced by permanent assembly, using, for example welding.

Although a system and method for compacting cannabis in a cannabis cone have been described hereinabove by way of illustrated embodiments thereof, they can be modified. It is therefore to be understood that numerous modifications may be made to the illustrative embodiments and that the scope of the claims should not be limited by the preferred embodiment but should be given the broadest interpretation consistent with the description as a whole.

What is claimed is:

1. A system for compacting cannabis in a cannabis cone, the system comprising:

- a cone gripper that is movable between an open position and a closed position around the cannabis cone; wherein, while in the closed position, the cone gripper holding the cannabis cone;
- a compaction rod, having a tip, for compacting cannabis in the cannabis cone, while said cone gripper holding the cannabis cone; the compaction rod being reciprocable along an axis between a retracted position, wherein the tip is out of the cannabis cone, and an extended position, wherein the tip is inserted in the cannabis cone;
- a protective collar that is movable within the cannabis cone, coaxially thereof, near the open top thereof, so as to define a barrier between the compaction rod and the cannabis cone when the compaction rod reciprocates in the cannabis cone.

2. The system as recited in claim 1, further comprising:

- a cone holder having a bore for receiving the cannabis cone therein and for holding the cannabis cone in a first position along the axis; and
- a cone-raising mechanism for moving the cannabis cone up to a second position along the axis.

3. The system as recited in claim 2, further comprising an inverted funnel positioned coaxially with the axis so as to be positioned on a side of the cone gripper opposite the cone holder; the cone-raising mechanism being further configured for moving the cannabis cone through the inverted funnel up to the second position along the axis, wherein the cannabis cone extends partially out of the inverted funnel from a side thereof opposite the cone-raising mechanism.

4. The system as recited in claim 2, wherein the bore of the cone holder is frusto-conical.

5. The system as recited in claim 2, wherein the cone holder is one of a plurality of cone holders mounted in a carrousel.

6. The system as recited in claim 2, wherein the cone-raising mechanism includes a linear actuator having an output shaft and a rod secured to the output shaft so as to define an extension thereof.

7. The system as recited in claim 6, wherein the cone-raising mechanism further comprising a course length adjusting assembly that limits the course of the rod.

8. The system as recited in claim 7, wherein the rod includes an enlarged portion defining an impactor and the course length adjusting assembly includes a mechanical stop having a hole that receives the rod therethrough and that is smaller than the impactor.

9. The system as recited in claim 1, wherein the protective collar is movable by the compaction rod, when the compaction rod moves from the retracted position to the extended position, between a compact position and a generally annular position within the cannabis cone, coaxially thereof.

10. The system as recited in claim 9, wherein the protective collar includes a mounting body, jaws mounted to the mounting body for pivotal movements between close and open positions, and a biasing member for biasing the jaws towards the close position; the jaws together defining an opening to receive the compaction rod therein and being movable from the close position to the open position under the passage of the compaction rod through the opening.

11. The system as recited in claim 10, wherein the biasing member is in the form of a resilient ring that is mounted around the jaws.

12. The system as recited in claim 11, wherein the each of the jaws includes a notch to receive the resilient ring.

13. The system as recited in claim 1, wherein the cone gripper includes two fingers, each including an arcuate tapered channel that cooperates to form a frusto-conical opening that substantially complements the cannabis cone.

14. The system as recited in claim 1, wherein the compaction rod is actuated by a linear actuator.

15. A system for compacting cannabis in a cannabis cone, the system comprising:

a cone holder having a bore for receiving the cannabis cone therein and for holding the cannabis cone in a first position along an axis;

a cone-raising mechanism for moving the cannabis cone up to a second position along the axis;

a cone gripper that is movable between an open position and a closed position around the cannabis cone while the cannabis cone is at the second position; wherein, while in the closed position, the cone gripper holding the cannabis cone;

a compaction rod, having a tip, for compacting cannabis in the cannabis cone while the cannabis rod is held by the cone gripper; the compaction rod being reciprocable along the axis between a retracted position, wherein the tip is out of the cannabis cone, and an extended position, wherein the tip is inserted in the cannabis cone;

a protective collar that is movable, by the compacting rod, within the cannabis cone, coaxially thereof, near the open top thereof, so as to define a barrier between the compaction rod and the cannabis cone when the compaction rod reciprocates in the cannabis cone;

wherein, the cone gripper, while the cannabis cone is at the second position, is operated to apply a gripping force onto the cannabis cone which is lower than a compacting force reached by the compaction rod between the retraced and extended positions thereof, so that the cannabis cone partly moves in a same direction with the compaction rod along the axis, gradually diminishing the compacting force.

* * * * *